United States Patent [19]

Mitchell

[11] 4,177,866

[45] Dec. 11, 1979

[54] SYSTEM FOR BORING RAISES HAVING PORTIONS OF DIFFERENT DIAMETERS

[75] Inventor: Howard E. Mitchell, Duncanville, Tex.

[73] Assignee: Dresser Industries, Inc., Dallas, Tex.

[21] Appl. No.: 910,725

[22] Filed: May 30, 1978

[51] Int. Cl.[2] ..... E21C 23/00

[52] U.S. Cl. ..... 175/53; 175/268; 175/344

[58] Field of Search ..... 175/58, 334, 267, 268, 175/263, 334, 335, 342, 381, 230; 299/60

[56] References Cited

U.S. PATENT DOCUMENTS

| | | | |
|---|---|---|---|
| 2,654,575 | 10/1953 | Kammerer | 175/335 |
| 2,841,380 | 7/1958 | Thassy | 175/267 X |
| 3,387,893 | 6/1968 | Hoever | 299/60 |
| 3,858,667 | 1/1975 | Goodfellow | 175/53 |
| 4,071,098 | 1/1978 | Dively et al. | 175/53 |
| 4,083,416 | 4/1978 | Still et al. | 175/258 X |

*Primary Examiner*—James A. Leppink
*Assistant Examiner*—Richard E. Favreau
*Attorney, Agent, or Firm*—Eddie E. Scott

[57] ABSTRACT

A raise boring system is provided for boring raise holes wherein the finished raise holes have portions of different diameters. The system includes a raise head with a central drive stem defining an axis of rotation. Primary cutter means are positioned on the raise head for disintegrating the earth formations out to a first radial distance from said axis of rotation. Expanding secondary cutter means are positioned on the raise head for selectively disintegrating earth formations from said first radial distance out to additional and greater radial distances from said axis of rotation. The expanding secondary cutter means may be selectively located in a first position either beneath or in the same plane as the primary cutter means during boring at said first radial distance from said axis of rotation and selectively located in additional positions for boring at greater radial distances from said axis of rotation. Expansion means are provided for moving said expanding secondary cutter means to said additional positions during the boring operation.

7 Claims, 10 Drawing Figures

SYSTEM FOR BORING RAISES HAVING PORTIONS OF DIFFERENT DIAMETERS

BACKGROUND OF THE INVENTION

The present invention relates to the art of earth boring and, more particularly, to a raise boring head for boring raise holes in a mine by enlarging a pilot hole into a raise hole having a larger diameter than the pilot hole.

A relatively large diameter hole may be provided between a first location and a second location in a mine or other underground works by an operation commonly referred to as raise drilling. A raise drilling operation begins by drilling a small diameter pilot hole through the earth from a first location to an opening at the second location using a small diameter pilot bit. After the pilot hole is completed, the pilot bit is removed from the drill string and a large diameter raise bit or raise head attached. The raise head is rotated and drawn along the pilot hole, thereby enlarging the pilot hole to the desired size.

As shown in U.S. Pat. No. 3,659,659 to Carl L. Lichte, patented May 2, 1972, raise bits of the prior art generally include a bit body positioned about a central bit axis with rolling cutters mounted at various distances from the central bit axis for disintegrating the earth formations. The rolling cutters may be locked in place on the bit by various locking mechanisms. For example, locking mechanisms are shown in U.S. Pat. No. 3,203,492 to C. L. Lichte, patented Aug. 31, 1965; in U.S. Pat. No. 3,705,635 to William M. Conn, patented Dec. 12, 1972; and in U.S. Pat. No. 3,612,196 to Robert L. Dixon, patented Oct. 12, 1971. The cutters may be positioned to cut the working face according to various geometries. For example, cutter locations are shown in U.S. Pat. No. RE27,597 to M. L. Talbert, patented Mar. 13, 1973, in U.S. Pat. No. 3,805,901 to William D. Coski, patented Apr. 23, 1974, and in U.S. Pat. No. 3,638,740 to Dan B. Justman, patented Feb. 1, 1972. A lubrication system may be provided to transmit lubricant to the bearings of the rolling cutters, as shown in U.S. Pat. No. 3,675,729 to William J. Neilson, patented July 11, 1972.

In certain large diameter hole boring operations, it is necessary to line the finished borehole with some type of lining material. For example, the hole may be lined to prevent sluffing or erosion of the finished shaft. There may be times, depending on the types of formations being bored, when it is unnecessary to line the entire shaft. In some circumstances it may be desirable to use several different lining thicknesses. In these instances it is generally necessary to provide a finished shaft of a fixed insided diameter. It will therefore be appreciated that a need exists for a raise boring system for boring raise holes of different diameters.

DESCRIPTION OF PRIOR ART

Prior to the present invention it was necessary to bore a hole of a fixed diameter and line it with a uniform diameter lining. The only other option was to bore the lower portion of the hole to a certain maximum diameter, lower the raise head, drop off the raise head used to bore the maximum diameter hole and go back up the hole with a smaller diameter raise head. This, of course, could be done any number of times to give a multi-diameter bored shaft of decreasing diameter from bottom to top and could result in a partially lined shaft and/or a lined shaft with varying liner thickness.

In U.S. Pat. No. 3,659,660 to William M. Conn, patented May 2, 1972, a large diameter bit for shallow angle holes is shown. The bit includes a plurality of drilling stages surrounding a central shaft. Integral stabilization sections are included after each drilling stage.

In U.S. Pat. No. 3,231,029 to Douglas F. Winberg, patented Jan. 25, 1966, an articulated drilling shaft for raise drilling is shown. The raise drilling bit shown in this patent includes a follower having an effective diameter when rotating that is substantially equal to the diameter of the raise hole that is being drilled by the cutterhead.

In U.S. Pat. No. 3,866,698 to John M. Stanley, patented Feb. 18, 1975, a raise drilling bit is shown for producing a raise bore about a pilot hole including a drill head having an upper surface for mounting cutter assemblies. A lower surface is spaced from said upper surface and has a drive stem attached thereto. The drive stem is adapted for a limited or floating movement with respect to said upper mounting surface.

In U.S. Pat. No. 4,010,808 to Thomas F. Youngblood, patented Mar. 8, 1977, an expandable raise bit is shown. A bit is provided that includes a bit body defining a bit axis of rotation. Primary cutter means are positioned on the bit body for disintegrating the formations out to a first radial distance from said bit axis of rotation. Secondary cutter means are adapted to be connected to the bit body and can be located in position for cutting between said first radial distance and a larger second radial distance. An expansion unit is positioned between said secondary cutter means and said bit body.

SUMMARY OF THE INVENTION

The present invention provides a raise boring system useful for boring holes having sections of various diameters. The present invention provides a raise boring head with the capability of being either contracted or expanded during the raise boring operation to provide a finish bored raise having various diameters. The raise boring system of this invention provides a finish raise of either increasing or decreasing diameters from bottom to top. Prior art raise boring heads only had the capability of producing a finish bored raise of decreasing diameter from bottom to top. The raise boring head provided by this invention may be contracted or expanded during the raise boring operation without lowering the head and mechanically removing or adjusting a portion of the raise head.

The raise boring head of the present invention is constructed in one or more stages. The primary stage is of a fixed diameter. The secondary portion comprises the contracting/expanding portion. The minimum contracted diameter of the contracting/expanding portion may be smaller, equal to or greater than the diameter of the primary stage. The rolling cutting elements on the contracting/expanding portion allow cutting the wall of the hole as the raise head is being expanded, and provide stabilization during the expanded raising mode. In the contracted mode, all or some of the cutting elements used to cut the larger diameter(s) are inside of the diameter of the first stage. In one embodiment of the present invention, rolling cutting elements are mounted on telescoping frameworks which are extended and contacted by hydraulic cylinders in a linear motion. In another embodiment, the system allows a framework to swing out from beneath the fixed diameter first stage.

The above and other features and advantages of the present invention will become apparent from a consideration of the following detailed description of the invention when taken in conjunction with the accompanying drawings.

DETAILED DESCRIPTION OF THE INVENTION

Figure 1:
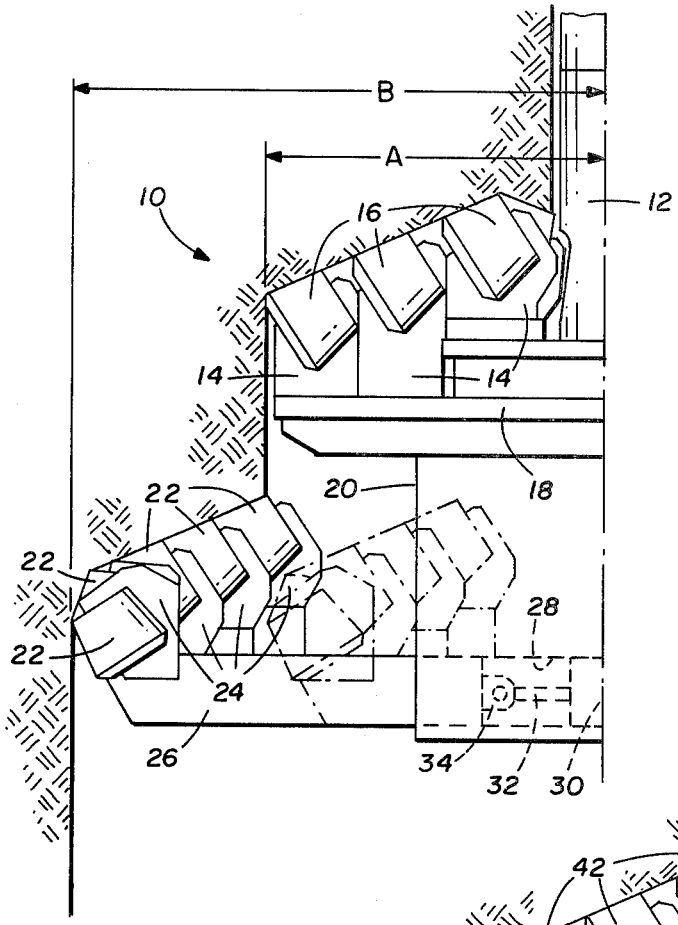
FIG. 1 illustrates a raise head constructed in accordance with the present invention.

Referring now to the drawings and, in particular, to FIG. 1, a cutaway view of a raise head 10 constructed in accordance with the present invention is shown. A drive stem 12 projects from the main body portion of the raise head 10. The upper portion of the drive stem 12 is threaded to allow the raise head 10 to be easily connected to, and disconnected from, a rotary drill string (not shown). During the boring of a large diameter raise hole, a small diameter pilot hole is initially drilled from a first location to a second location. The small diameter pilot bit is disconnected from the drill string and a raise head such as raise head 10 is connected to the drill string. The drill string is rotated and an axial force is applied to the drill string. The raise head is rotated and drawn along the small diameter pilot hole to form the desired large diameter raise hole.

A first cutting stage for disintegrating the formations out to a first radius "A" from the central axis of raise head 10 forms a portion of the body of raise head 10. The first stage includes a series of cutter saddles 14 that form a portion of the body of the raise head 10. Rolling cutters 16 are mounted in the cutter saddles 14. The plate 18 supports the first cutting stage. It is to be understood that the first cutting stage includes other cutter saddles and cutters mounted around the stem 12 in a manner well known in the art. As the head 10 is rotated, the first cutting stage will contact and disintegrate the formations out to a first radius "A" from the central axis of the raise head 10.

A second cutting stage is located radially within the first cutting stage and is adapted to selectively disintegrate the formations between the first radius "A" and additional and greater radii such as the second radius "B" from the central axis of the raise head 10. The second cutting stage is connected to the first cutting stage by a cylindrical support member 20. The second cutting stage includes a multiplicity of rolling cutters 22 mounted in cutter saddles 24. The cutters and saddles are mounted on a supporting frame 26. The supporting frame 26 can be selectively moved radially outward from the central axis of the raise head 10. The supporting frame 26 is mounted to slide within a cavity 28 in the cylindrical support member 20. A double acting pneumatic cylinder 30 is mounted within the cavity 28. The piston rod 32 of the double acting pneumatic cylinder 30 is connected to the support frame 26 by connection 34. Actuation of cylinder 30 will move the cutters 22 of the second cutting stage radially inward or outward. The raise head 10 is shown with the second cutting stage expanded to form a borehole having a radius "B" from the axis of rotation. The expansion is controlled by actuation of the double acting pneumatic cylinder 30. As shown in phantom in FIG. 1, retraction of the pneumatic cylinder 30 withdraws the second cutting stage to a position entirely within the radius "A" of the first cutting stage.

It is to be understood that the expanding secondary stage can be selectively located in a first position either beneath or in the same plane as the primary stage during boring at said first radial distance and selectively located in additional positions for boring at greater radial distances from said axis of rotation. The expansion means is provided for positioning said expanding portion in said additional positions during the boring operation. The raise boring head provided by this invention may be contracted or expanded during the raise boring operation without lowering the raise head and mechanically removing or adjusting a portion of the raise head. The rolling cutters 22 on the contracting/expanding secondary portion allow cutting the wall of the hole as the raise head 10 is being expanded, and provide stabilization during the expanded raising mode. In the contracted mode, all or some of the cutters 22 used to cut the larger diameter(s) are inside of the diameter "A" of the first stage. In the embodiment shown in FIG. 1, the rolling cutters 22 are mounted on the telescoping frameworks 26–34 which provide extension and contraction in a linear motion.

Figure 2:
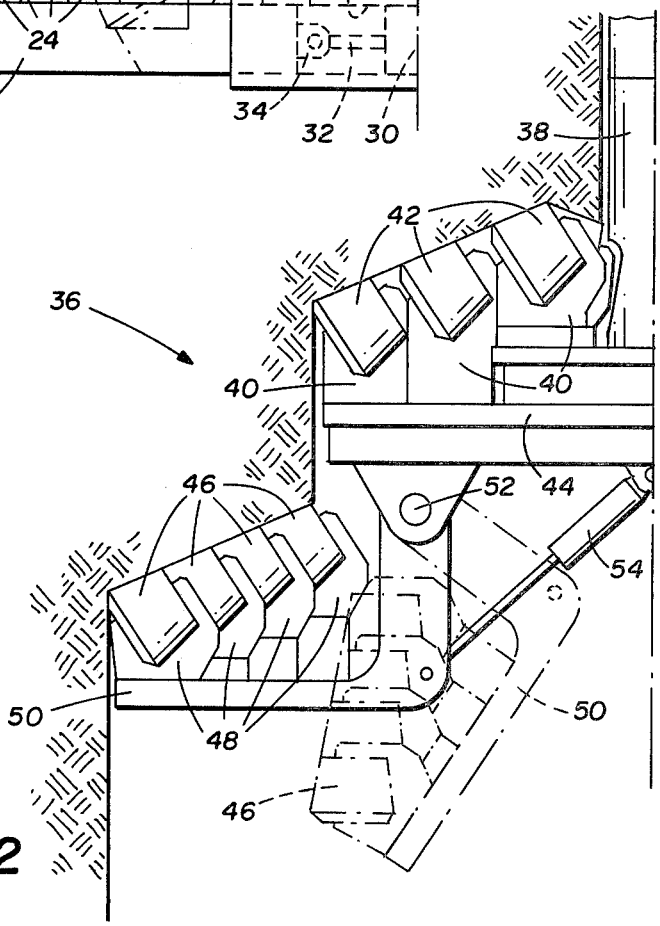
FIG. 2 illustrates another embodiment of a raise head constructed in accordance with the present invention.
Figure 3:
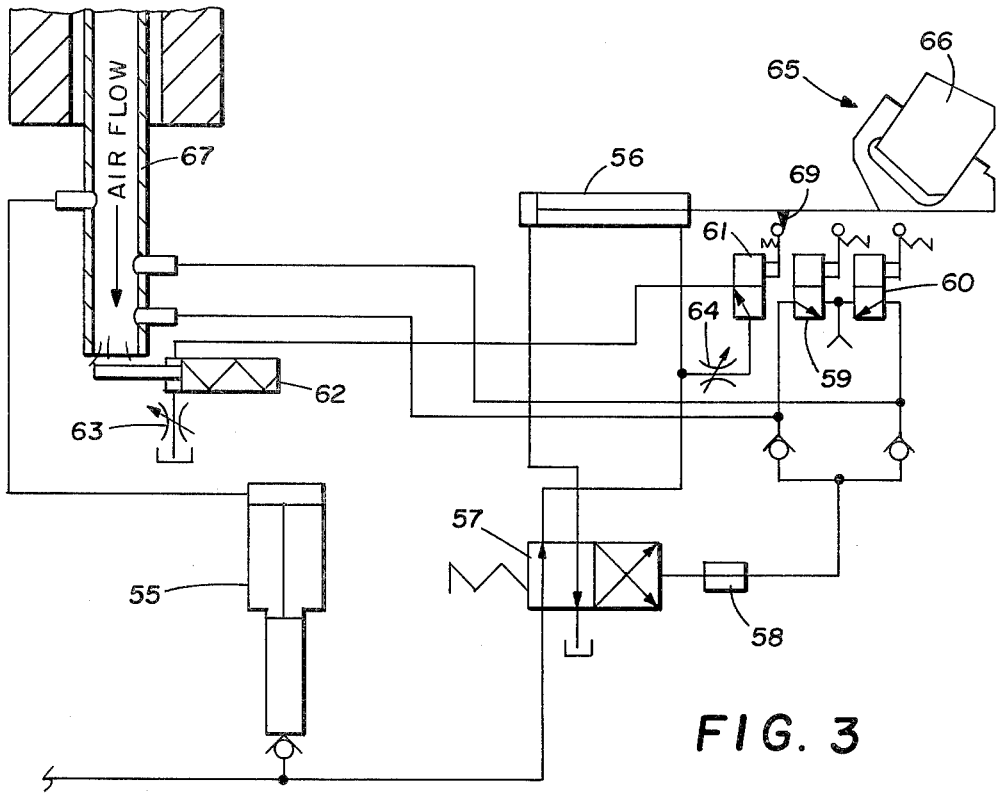
FIGS. 3–9 show circuit diagrams for extending the second cutting stage of the raise heads shown in FIGS. 1 and 3.

Referring now to FIG. 2, a cutaway view of a second embodiment of a raise head 36 constructed in accordance with the present invention is shown. A drive stem 38 projects from the main body portion of the raise head 36. The upper portion of the drive stem 38 is threaded to allow the raise head 36 to be easily connected to, and disconnected from, a rotary drill string (not shown). During the boring of a large diameter raise hole, a small diameter pilot hole is initially drilled from a first location to a second location. The small diameter pilot bit is disconnected from the drill string and a raise head such as raise head 36 is connected to the drill string. The drill string is rotated and an axial force is applied to the drill string. The raise head is rotated and drawn along the small diameter pilot hole to form the desired large diameter raise hole.

A first cutting stage for disintegrating the formations out to a first radius from the central axis of raise head 36 forms a portion of the body of raise head 36. The first stage includes a series of cutter saddles 40 that form a portion of the body of the raise head 36. Rolling cutters 42 are mounted in the cutter saddles 40. The plate 44 supports the first cutting stage. It is to be understood that the first cutting stage includes other cutter saddles and cutters mounted around the stem 34 in a manner well known in the art. As the head 36 is rotated, the first cutting stage will contact and disintegrate the formations out to a first radius from the central axis of the raise head 36.

A second cutting stage is adapted to selectively disintegrate the formations between the first radius and additional and greater radii, from the central axis of the raise head 36. The second cutting stage includes a multiplicity of rolling cutters 46 mounted in cutter saddles 48. The cutters and saddles are mounted on a supporting frame 50. The supporting frame 50 is connected to hinge 52 that allows the supporting frame 50 to be rotated outward to a multiplicity of different locations. The rolling cutters 46 can be selectively moved radially outward from the central axis of the raise head 36. A double-acting hydraulic cylinder 54 is connected between the supporting frame 50 and the plate 44. Actuation of cylinder 54 will move the cutters 46 of the second cutting stage radially inward or outward. The raise head 36 is shown with the second cutting stage expanded to form a borehole having the largest radius from the axis of rotation. The expansion is controlled by actuation of the double-acting hydraulic cylinder 54. As shown in phantom in FIG. 2, retraction of the hydraulic cylinder 54 withdraws the second cutting stage to a position entirely within the radius of the first cutting stage.

Referring now to FIGS. 3–9, a series of circuit diagrams show the extension and retraction of a second cutting stage such as the second cutting stages shown in FIGS. 1 and 2. As shown in FIGS. 3–9, a second cutting stage 65 is moved to and from the retracted position by the hydraulic cylinder 56. The second cutting stage 65 is shown in the fully retracted position in FIG. 3. As shown in FIGS. 3–9, item 55 is an air-driven hydraulic intensifier. Item 56 is the double-acting hydraulic cylinder which is attached to and activates the structure upon which the raise cutters 66 are mounted. Item 57 is a four-way hydraulic valve which is spring loaded on one side and activated by a low pressure hydraulic actuator, item 58, on the other. Items 59, 60 and 61 are limit switches. Item 61 is held in the position shown by a stop block attached to the end of the expanding portion of the raise head. Item 62 is a small, short-stroke, single-acting, spring-return, hydraulic cylinder. Items 63 and 64 are flow control valves. In the position shown in FIG. 3, the expanding stage 65 of the raise head is fully contracted. The air flowing through the control manifold 67 is flowing past the cylinder rod of item 62 to atmosphere (i.e., the system is depressurized).

Figure 4:
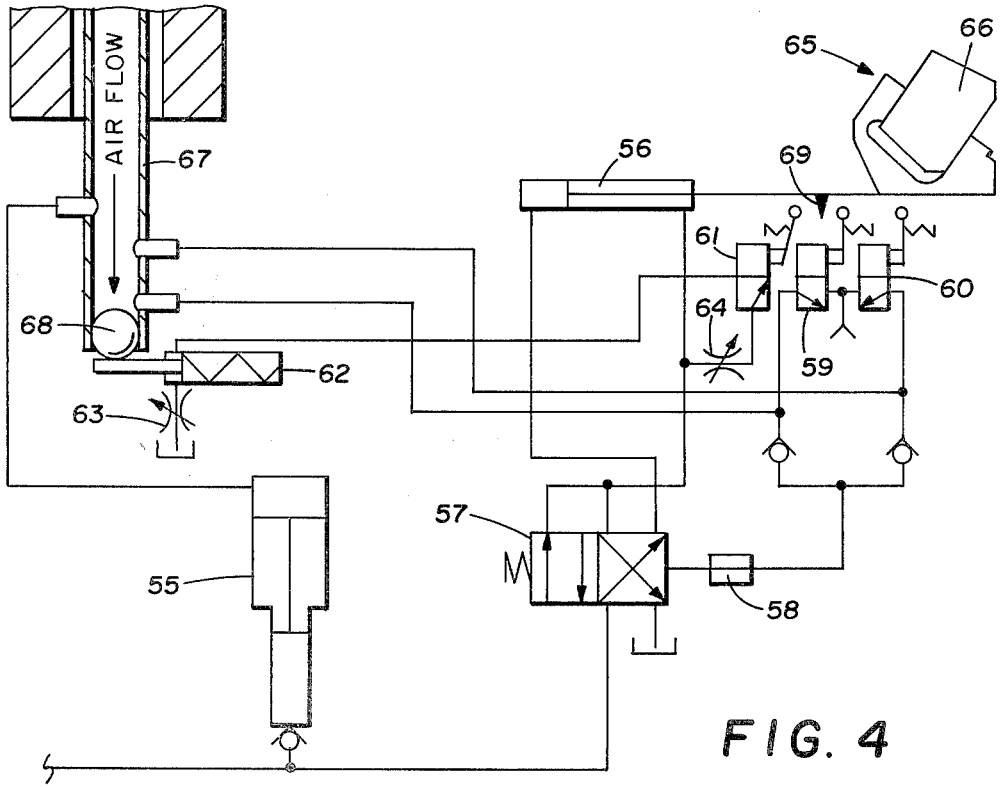

In FIG. 4, the system is shown in the pumping mode that allows the second or expanding cutting stage 65 to be moved to a first position for drilling at a first expanded radius from the bit central axis, said first expanded radius being greater than the radius of the primary stage. A rubber ball 68 is dropped through the raise machine swivel (not shown). It falls into the manifold 67, thus blocking the exit of air. The air enters lines A, B and C which activates items 55 and 58. Item 58 activates at a lower pressure than item 55 thus insuring that item 57 shifts to the proper position before pumping begins. Item 57 opens which allows high pressure oil to flow into the piston side of item 56 thus the expanding portion 65 of the raise head begins to move. Oil is forced out of the cylinder rod side of item 56 and follows the path of least resistance to the tank. As the expanding portion 65 of the raise head moves out, the lever of item 61 moves out under spring pressure.

Figure 5:
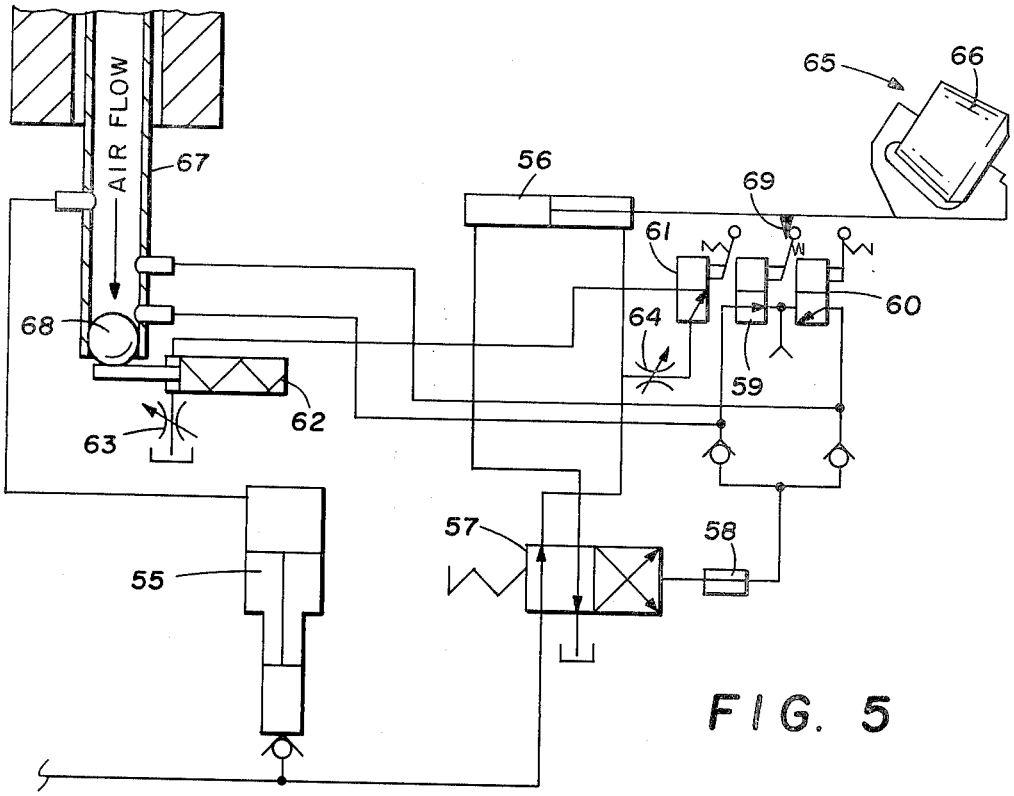

Referring now to FIG. 5, the locking of the second cutting stage 65 in the first expanded radius position is illustrated As will be explained subsequently, the present invention allows the second cutting stage to be located at a multiplicity of expanded radius positions for boring raises of various diameters. A stop 69 on the expanding portion of the raise head trips item 59 which allows the air to exit to the atmosphere, thus item 55 stops pumping. The expanding second cutting stage is locked in the first expanded radius position.

Figure 6:
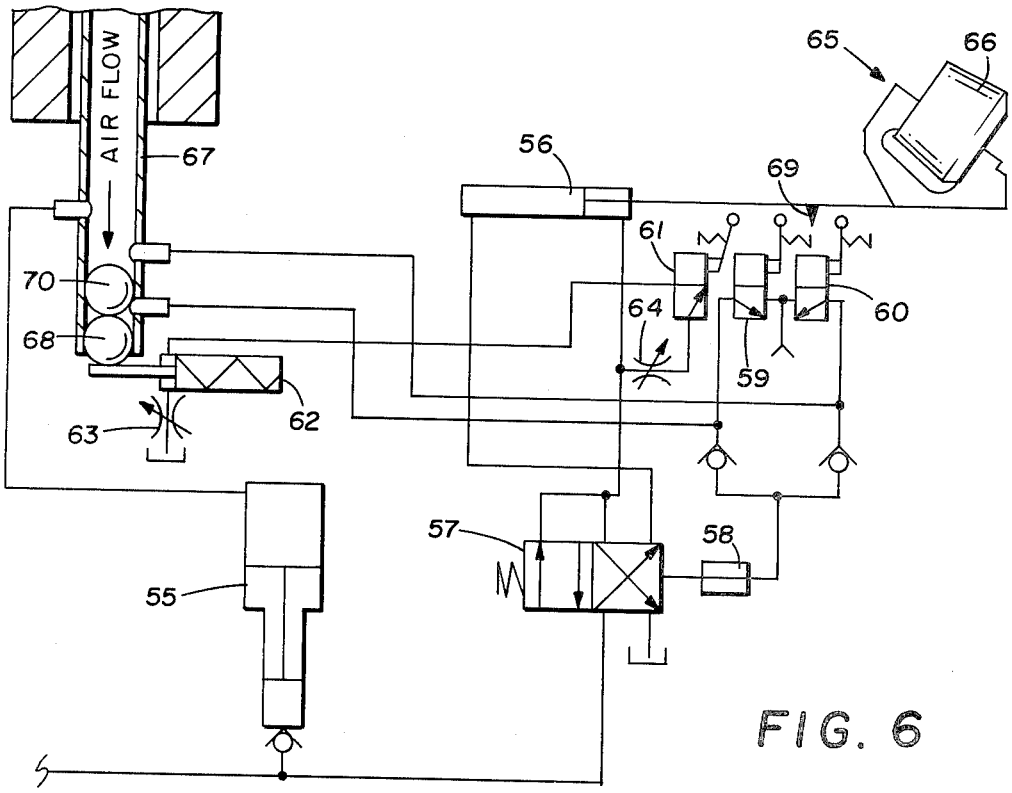
Figure 7:
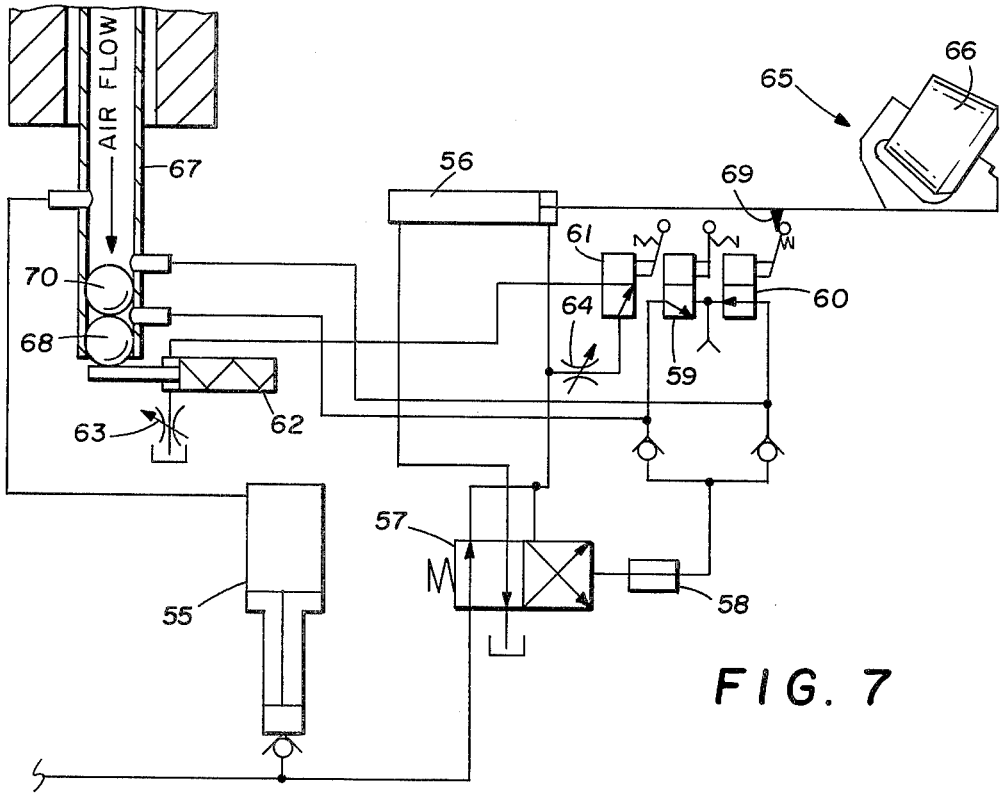

Referring now to FIG. 6, the system is shown in the mode that extends the expanding cutting stage 65 from the first expanded radius position to a second expanded radius position. A second rubber ball 70 is dropped into the control manifold 67 sealing off line A. Lines B and C become pressurized. Air through line B activates item 58 which opens item 57 again. Air through line C activates item 55. High pressure oil flows into the piston side of item 56. The expanding cutting stage 65 moves to a greater radius from the central axis of the bit. The expanding cutting stage 65 is locked in a second expanded radius position as illustrated in FIG. 7. The stop 69 on the expanding portion of the raise head trips item 60 which allows air to exit to the atmosphere, thus item 55 stops pumping. The expanding cutting stage 65 is locked in the second expanded radius position.

Figure 8:
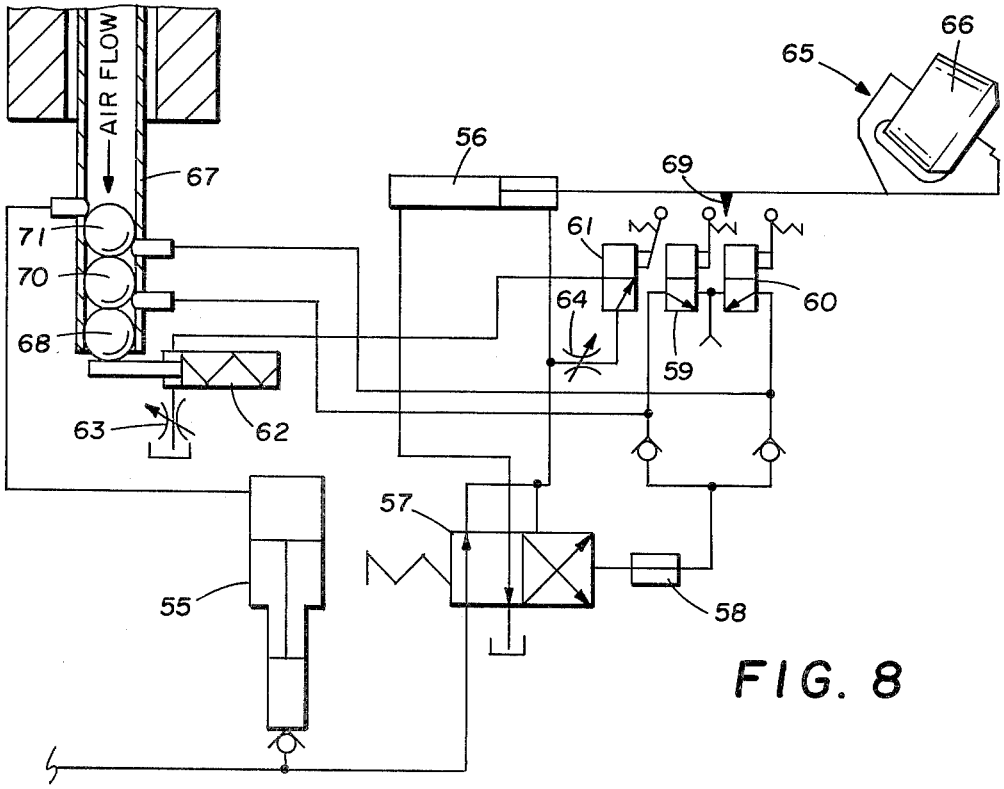
Figure 9:
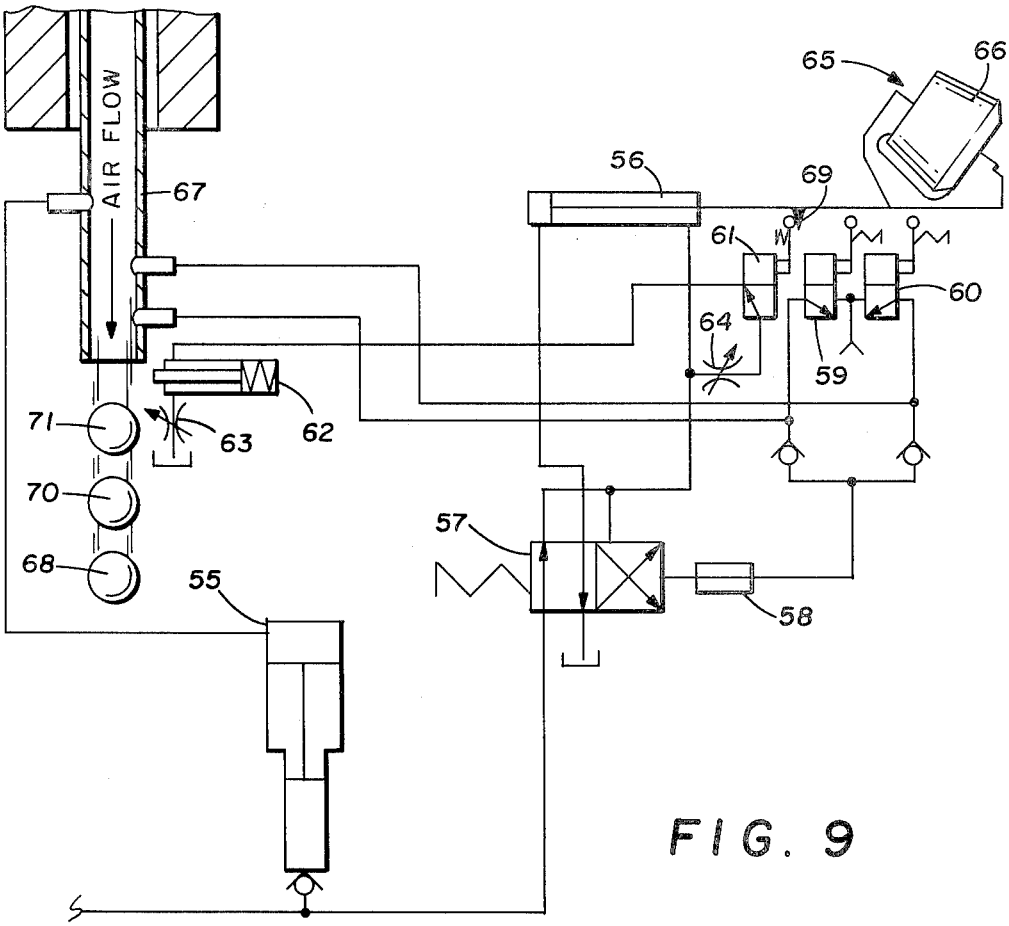

Referring now to FIG. 8, the retraction of expanding cutting stage 65 is illustrated. A third rubber ball 71 is dropped into the control manifold 67 sealing off line B. Line C becomes pressurized activating item 55. High pressure oil flows through item 57 into the rod side of item 56. This causes the double-acting hydraulic cylinder 56 to retract the second cutting stage 65. The stop 69 on the expanding stage 65 of the raise head resets items 59 and 60 as it is retracted. At the end of its stroke, item 61 is tripped allowing oil to flow into item 62. The cylinder rod of item 62 moves back allowing all three rubber balls 68, 70 and 71 to be exhausted. The air pressure in line C drops and item 55 stops pumping. Oil leaks at a very slow rate through item 63 thus allowing the cylinder rod of item 62 to return to its idle position slowly. The rate can be preset. It will be appreciated that if it is desired to extend the raise head only to the first expanded radius, the first rubber ball 68 is dropped in. The system can be retracted by the dropping in the two rubber balls 70 and 71. Further, it can be seen that if it is desired to cut more than three diameters, it is only necessary to design into the system the required number of orifices in the control manifold and add the necessary limit switches, etc.

Figure 10:
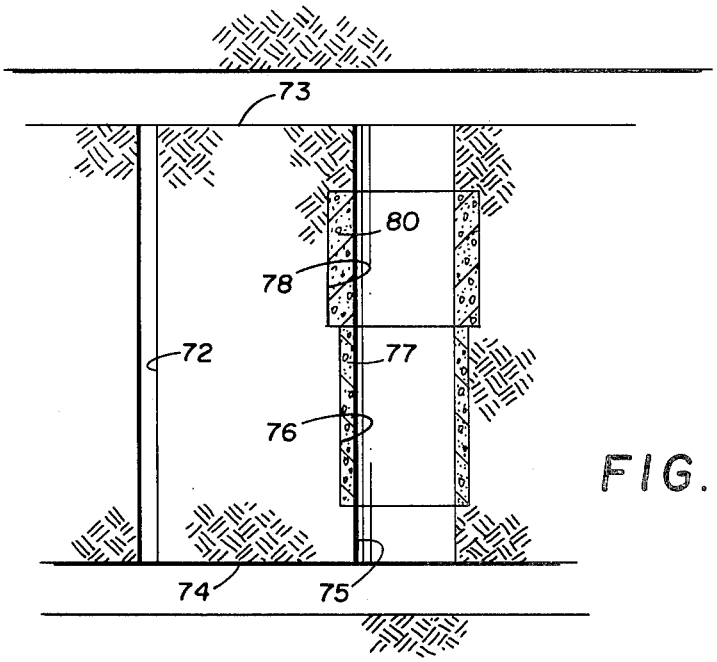
FIG. 10 illustrates the boring of a raise hole extending between two levels of a mine.

The structural details of various embodiments of a raise head constructed in accordance with the present invention having been described, a raise drilling operation will now be considered with reference to FIG. 10. The raise drilling operation begins by drilling a small diameter pilot hole such as the pilot hole 72 through the earth from a first location 73 to an opening at a second location 74 using a small diameter pilot bit. After the pilot hole is completed, the pilot bit is removed from the drill string and a raise head such as the raise head 10 shown in FIG. 1 or the raise head 36 shown in FIG. 2 is attached to the drill string. The raise head is rotated and drawn along the pilot hole, thereby enlarging the pilot hole to the desired size. A completed raise hole 75 is shown to the right of the pilot hole 72. The pilot hole 72 is shown for illustration purposes and it is to be understood that the pilot hole 72 may be enlarged by a subsequent raise drilling operation.

The expanding raise head of the present invention is adapted to bore raise holes having portions of various diameters. The raise boring head provided by this invention may be contracted or expanded to give a finish bored raise of either increasing or decreasing diameters from bottom to top or to allow the bit to be lowered through the completed hole. The raise boring head provided by this invention may be contracted or expanded during the raise boring operation without lowering the raise head and mechanically removing or adjusting a portion of the raise head.

The raise hole 75, as shown in FIG. 10, extends from the first location 73 to the second location 74. The expanding raise bit of the present invention can be used to bore the entire raise hole 75 in a single operation without lowering the raise head until the operation is completed. As will be explained subsequently, the lowering operation can be accomplished without the often encountered problem of the raise head becoming stuck in the hole. After completion of the pilot hole, the pilot bit is removed and the raise head connected to the drill string. The drill string is rotated and drawn upward. The second stage cutters are located in the retracted position inside the fixed radius, for example, the radius "A" shown in FIG. 1. After a portion of the raise hole 75 is bored, the hydraulic cylinder is actuated moving the expanding second stage cutters out to an intermediate diameter to bore the portion 76 of the raise hole. This can be accomplished without lowering the raise head and in a continuous raise drilling operation. After the portion 76 is completed, the hydraulic cylinder is again actuated to move the second stage cutters out to an even larger radius at the fully extended position radius to bore the portion 78 of the raise hole. This is accomplished without lowering the raise head and in a continuous raise drilling operation.

Once the portion 78 is completed, the double-acting hydraulic cylinder is actuated to retract the second stage cutters so they are located within the radius "A" and a further portion of the raise hole 75 is completed. Once the raise head is ready to break through to the level 73, the raise head is lowered back down to the second level 74 to remove the raise head. This was done because the diameter of the raise hole 75 is so great that causing the raise head to break through to the first location 73 would interfere with the raise drilling machine located at the level 73. The lowering of a raise head through a previously bored raise hole can be a very difficult procedure. The raise head can become stuck in the hole by being lodged on portions of the formations through which the hole extends. Since the diameter of the raise head is normally the same size diameter as the hole, the lowering operation is difficult. It will be appreciated that in boring the raise hole 75, the lowering operation was simplified because the second stage cutters could remain in the retracted position during the lowering of the raise head through the portions 76 and 78 of the raise hole 75. It can also be appreciated that in circumstances where the lowering of the raise head can be a problem, the cutters can be maintained at a slightly expanded position throughout the drilling of the entire raise hole and once the raise head is lowered back through the raise hole the cutters can be retracted to the entirely retracted position. This substantially simplifies the lowering operation.

With the raise hole 75 completed, the linings 77 and 80 are put in place. Because of the particular formations encountered in the portion 78 of the raise hole 75, lining of a greater thickness than the lining 77 is required. By being able to drill the enlarged portion 78 it is possible to provide this increased thickness lining 80. It should be noted that the inside diameters of the linings 77 and 80 are the same and that the inside diameters of both linings 77 and 80 are also the same as the unlined portion of the raise hole 75. This provides a smooth inside wall for the entire raise hole 75.

The embodiments of the invention in which an exclusive property or privilege is claimed are defined as follows:

1. A method of raise drilling by enlarging a pilot hole extending between an upper level of a mine and a lower level of a mine into a large diameter hole extending between said upper level and said lower level, comprising the steps of:

boring said pilot hole between said upper level and said lower level;

positioning a raise drilling machine at said upper level of a mine;

rotating and drawing a raise head along said pilot hole from said lower level to said upper level to enlarge the pilot hole to form said large diameter hole by disintegrating the formations surrounding the pilot hole, said raise head having a primary section for disintegrating the formations surrounding the pilot hole out to a first radial distance from the pilot hole and a secondary stage; and expanding said raise head during the rotating and drawing step to position said secondary stage at a second and greater radial distance from the pilot hole.

2. The raise drilling method of claim 1 including the step of positioning first and second linings in said large diameter hole, wherein said first and second linings have the same inside diameter but said first lining has an outside diameter that extends to said first radial distance and said second lining has an outside diameter that extends to said second radial distance.

3. A raise boring head for attachment to a drill string and enlarging a pilot hole extending between an upper level and a lower level of a mine into a larger diameter raise hole extending between said upper level and said lower level by being drawn upward along said pilot hole, wherein said raise hole will have a portion of increased diameter, comprising:

a body portion defining an axis of rotation;

a drive stem attached to said body portion for projecting into said pilot hole and attaching to said drill string;

primary cutter means positioned on said body portion for disintegrating the formations out to a first radial distance from said axis of rotation, said primary cutter means comprising a series of cutter saddles mounted on said body portion and rolling cutters mounted in said cutter saddles;

secondary cutter means positioned on said body portion and adapted to be selectively located in a first position for disintegrating the formations between said first radial distance from said axis of rotation and a second radial distance from said axis of rotation, said second radial distance being greater than said first radial distance, and selectively located in subsequent positions for disintegrating the formations between said second radial distance from said axis of rotation and subsequent radial distances from said axis of rotation, said subsequent radial distances being greater than said second radial distance, said secondary cutter means comprising a series of cutter saddles mounted on said body portion and rolling cutters mounted in said cutter saddles; and expanding means positioned on said body portion for moving said secondary cutter means and locating said secondary cutter means and locating said secondary cutter means in said second and subsequent positions for boring said portion of increased diameter of said raise hole.

4. A raise bit for attachment to a drill string and enlarging a pilot hole extending between an upper level and a lower level of a mine into a larger diameter raise hole extending between said upper level and said lower level by being drawn upward along said pilot hole and disintegrating the earth formations surrounding the pilot hole, comprising:

a bit body defining a bit axis of rotation;

a drive stem attached to said bit body for projecting into said pilot hole and attaching to said drill string;

primary cutter means on said bit body positioned at a first radial distance from said bit axis of rotation for disintegrating the earth formations out to said first radial distance from said bit axis of rotation, said primary cutter means comprising a series of cutter saddles mounted on said bit body and rolling cutters mounted in said cutter saddles;

moveable support means;

secondary cutter means positioned on said moveable support means, said secondary cutter means comprising a series of cutter saddles mounted on said bit body and rolling cutters mounted in said cutter saddles;

means for allowing said secondary cutter means and said moveable support means to be moved relative to said bit body; and force means for selectively moving said secondary cutter means and moveable support means to a second radial and greater distance from said bit axis of rotation for selectively disintegrating the formations out to said second radial distance from said bit axis of rotation.

5. The raise bit of claim 4 wherein said means for allowing said secondary cutter means and said moveable support means to be moved relative to said bit body comprises an elongated frame that slides within a cavity in said bit body.

6. The raise bit of claim 4 wherein said means for allowing said secondary cutter means and said moveable support means to be moved relative to said bit body comprises a hinge element that allows said moveable frame to rotate with respect to said bit body.

7. The raise bit of claim 4 wherein said force means is a double-acting cylinder.

* * * * *